US012534867B2

(12) United States Patent
Verdin et al.

(10) Patent No.: US 12,534,867 B2
(45) Date of Patent: Jan. 27, 2026

(54) APPARATUSES FOR CONSTRUCTING DISPLACEMENT AGGREGATE PIERS

(71) Applicant: Geopier Foundation Company, Inc., Davidson, NC (US)

(72) Inventors: John Verdin, Davidson, NC (US); Kord J. Wissmann, Davidson, NC (US)

(73) Assignee: Geopier Foundation Company, Inc., Davidson, NC (US)

( * ) Notice: Subject to any disclaimer, the term of this patent is extended or adjusted under 35 U.S.C. 154(b) by 0 days.

(21) Appl. No.: 18/733,415

(22) Filed: Jun. 4, 2024

(65) Prior Publication Data

US 2024/0401295 A1 Dec. 5, 2024

Related U.S. Application Data

(60) Continuation of application No. 16/877,661, filed on May 19, 2020, now Pat. No. 12,000,106, which is a (Continued)

(51) Int. Cl.
*E02D 5/62* (2006.01)
*E02D 3/08* (2006.01)

(Continued)

(52) U.S. Cl.
CPC ..... *E02D 5/62* (2013.01); *E02D 3/08* (2013.01); *E02D 5/34* (2013.01); *E02D 7/24* (2013.01); *E02D 27/12* (2013.01)

(58) Field of Classification Search
CPC .... E02D 5/34; E02D 5/62; E02D 3/08; E02D 7/24; E02D 27/12
See application file for complete search history.

(56) References Cited

U.S. PATENT DOCUMENTS 2,023,966 A 12/1935 Montee
3,563,324 A 2/1971 Lauber (Continued)

FOREIGN PATENT DOCUMENTS

GB 191322409 A * 2/1914 ..... E02D 5/38
GB 281678 A * 6/1928 ..... E02D 15/04

(Continued)

OTHER PUBLICATIONS

Kim, Yong Hyun, Korean patent document KR-100412775-B1, machine translation. (Year: 2004).*

(Continued)

*Primary Examiner* — Tara Mayo

(74) *Attorney, Agent, or Firm* — E. Eric Mills; Todd A. Serbin; Maynard Nexsen PC

(57) ABSTRACT

Apparatuses for constructing displacement aggregate piers are disclosed. In one example, a mandrel is provided comprising a tamper head that has cutting teeth on the leading edge thereof. In another example, hydrojet nozzles are provided within one or more of the cutting teeth of the tamper head. In yet another example, the mandrel comprises grout tubes (or grout injection lines) and/or grout inspection lines. In yet another example, the mandrel and/or tamper head can comprise cutting teeth, hydrojet nozzles, grout tubes (or grout injection lines), grout inspection lines, and any combinations thereof.

16 Claims, 7 Drawing Sheets

Related U.S. Application Data division of application No. 14/916,731, filed as application No. PCT/US2014/054337 on Sep. 5, 2014, now Pat. No. 10,655,294.

(60) Provisional application No. 61/874,116, filed on Sep. 5, 2013.

(51) Int. Cl.

| | |
|---|---|
| ***E02D 5/34*** | (2006.01) |
| ***E02D 7/24*** | (2006.01) |
| ***E02D 27/12*** | (2006.01) |

(56) References Cited

U.S. PATENT DOCUMENTS

| | | | |
|---|---|---|---|
| 3,674,100 | A | 7/1972 | Becker |
| 3,851,490 | A | 12/1974 | Matsushita |
| 3,869,869 | A | 3/1975 | Pao Chen |
| 4,369,850 | A | 1/1983 | Baker |
| 4,623,027 | A | 11/1986 | Veririan |
| 4,790,689 | A | 12/1988 | Henn et al. |
| 5,249,892 | A | 10/1993 | Fox |
| 5,304,016 | A | 4/1994 | Kunito |
| 5,887,667 | A | 3/1999 | Van Zante et al. |
| 6,142,712 | A | 11/2000 | White et al. |
| 6,354,766 | B1 | 3/2002 | Fox |
| 6,484,422 | B1 | 11/2002 | Bain |
| 6,505,998 | B1 | 1/2003 | Bullivant |
| 6,675,919 | B2 | 1/2004 | Mosing |
| 7,226,246 | B2 | 6/2007 | Fox |
| 7,326,004 | B2 | 2/2008 | Wissmann et al. |
| 7,604,437 | B2 | 10/2009 | Wissmann et al. |
| 2002/0044839 | A1 | 4/2002 | Mosing |
| 2004/0115011 | A1 | 6/2004 | Fox |
| 2008/0205993 | A1 | 8/2008 | Wissmann et al. |
| 2010/0089660 | A1 | 4/2010 | Pearce |
| 2011/0052330 | A1 | 3/2011 | Wissmann |
| 2011/0070033 | A1 | 3/2011 | Melegari |

FOREIGN PATENT DOCUMENTS

| | | | | | |
|---|---|---|---|---|---|
| GB | 2188351 | B | * | 8/1988 | ..... E02D 27/48 |
| KR | 100412775 | B1 | * | 1/2004 | ..... E02D 5/46 |

OTHER PUBLICATIONS

International Search Report and Written Opinion issued in counterpart PCT Application No. PCT/US2014/054337 dated Dec. 30, 2014.

* cited by examiner

700

APPARATUSES FOR CONSTRUCTING DISPLACEMENT AGGREGATE PIERS

CROSS REFERENCE TO RELATED APPLICATIONS

This application is a continuation application which claims priority to U.S. application Ser. No. 16/877,661 filed on May 19, 2020, which is a divisional application which claims priority to U.S. application Ser. No. 14/916,731 filed on Mar. 4, 2016 (now U.S. patent Ser. No. 10/655,294, issued May 19, 2020), which is a 35 U.S.C. § 371 U.S. National Phase entry of International Application No. PCT/US2014/054337 entitled "Apparatuses for Constructing Displacement Aggregate Piers" having an international filing date of Sep. 5, 2014, which claims the benefit of U.S. Provisional Application Ser. No. 61/874,116 filed Sep. 5, 2013, each of which is incorporated by reference herein in its entirety.

TECHNICAL FIELD

The subject matter disclosed herein relates generally to the construction of aggregate piers used to support structures and more particularly to apparatuses and methods to efficiently construct displacement aggregate piers in difficult driving conditions and/or in soils requiring that the pier be grouted to achieve structural support.

BACKGROUND

Heavy or settlement sensitive facilities that are located in areas containing soft, loose, or weak soils are often supported on deep foundations. Such deep foundations are typically made from driven pilings or concrete piers installed after drilling. The deep foundations are designed to transfer structural loads through the soft soils to more competent soil strata. Deep foundations are often relatively expensive when compared to other construction methods.

Another way to support such structures is to excavate out the soft, loose, or weak soils and then fill the excavation with more competent material. The entire area under the building foundation is normally excavated and replaced to the depth of the soft, loose, or weak soil. This method is advantageous because it is performed with conventional earthwork methods, but has the disadvantages of being costly when performed in urban areas and may require that costly dewatering or shoring be performed to stabilize the excavation.

Yet another way to support such structures is to treat the soil with "deep dynamic compaction" consisting of dropping a heavy weight on the ground surface. The weight is dropped from a sufficient height to cause a large compression wave to develop in the soil. The compression wave compacts the soil, provided the soil is of a sufficient gradation to be treatable. A variety of weight shapes are available to achieve compaction by this method, such as those described in U.S. Pat. No. 6,505,998. While deep dynamic compaction may be economical for certain sites, it has the disadvantage that it induces large waves as a result of the weight hitting the ground. These waves may be damaging to existing structures. The technique is deficient because it is only applicable to a small band of soil gradations (particle sizes) and is not suitable for materials with appreciable fine-sized particles.

In recent years, aggregate columns have been increasingly used to support structures located in areas containing soft soils. The columns are designed to reinforce and strengthen the soft layer and minimize resulting settlements. The columns are constructed using a variety of methods including the drilling and tamping method described in U.S. Pat. Nos. 5,249,892 and 6,354,766; the tamper head driven mandrel method described in U.S. Pat. No. 7,226,246; the tamper head driven mandrel with restrictor elements method described in U.S. Pat. No. 7,604,437; and the driven tapered mandrel method described in U.S. Pat. No. 7,326,004; the entire disclosures of which are incorporated herein by reference.

The short aggregate column method (U.S. Pat. Nos. 5,249,892 and 6,354,766), which includes drilling or excavating a cavity, is an effective foundation solution when installed in cohesive soils in which the sidewall stability of the hole is easily maintained. The method generally consists of (a) drilling a generally cylindrical cavity or hole in the foundation soil (typically around 30 inches (76.2 cm)), (b) compacting the soil at the bottom of the cavity, (c) installing a relatively thin lift of aggregate into the cavity (typically around 12-18 inches (30.5-45.7 cm)), (d) tamping the aggregate lift with a specially designed beveled tamper head, and (e) repeating the process to form an aggregate column generally extending to the ground surface. Fundamental to the process is the application of sufficient energy to the beveled tamper head such that the process builds up lateral stresses within the matrix soil up along the sides of the cavity during the sequential tamping. This lateral stress build up is important because it decreases the compressibility of the matrix soils and allows applied loads to be efficiently transferred to the matrix soils during column loading.

The tamper head driven mandrel method (U.S. Pat. No. 7,226,246) is a displacement form of the short aggregate column method. This method generally consists of driving a hollow pipe (mandrel) into the ground without the need for drilling. The pipe is fitted with a tamper head at the bottom that has a greater diameter than the pipe and that has a flat bottom and beveled sides. The mandrel is driven to the design bottom of column elevation, filled with aggregate and then lifted, allowing the aggregate to flow out of the pipe and into the cavity created by withdrawing the mandrel. Tamper head is then driven back down into the aggregate to compact the aggregate. The flat bottom shape of tamper head compacts the aggregate. The beveled sides force the aggregate into the sidewalls of the hole, thereby increasing the lateral stresses in the surrounding ground. The tamper head driven mandrel with restrictor elements method (U.S. Pat. No. 7,604,437) uses a plurality of restrictor elements installed within the tamper head 112 to restrict the backflow of aggregate into the tamper head during compaction.

The driven tapered mandrel method (U.S. Pat. No. 7,326,004) is another means of creating an aggregate column with a displacement mandrel. In this case, the shape of the mandrel is a truncated cone, larger at the top than at the bottom, with a taper angle of from about 1 to about 5 degrees from vertical. The mandrel is driven into the ground, causing the matrix soil to displace downwardly and laterally during driving. After reaching the design bottom of the column elevation, the mandrel is withdrawn, leaving a cone shaped cavity in the ground. The conical shape of the mandrel allows for temporarily stabilizing of the sidewalls of the hole such that aggregate may be introduced into the cavity from the ground surface. After placing a lift of aggregate, the mandrel is re-driven downward into the aggregate to compact the aggregate and force it sideways into the sidewalls of the hole. Sometimes, a larger mandrel is used to compact the aggregate near the top of the column.

SUMMARY

The present disclosure relates generally to apparatuses and methods for constructing displacement aggregate piers in difficult driving conditions and/or in soils requiring that the pier be grouted to achieve structural support. In some embodiments, a system for constructing aggregate piers comprising a mandrel is provided, where the mandrel may include an upper feed tube portion, a tamper head, and a passage extending therethrough for feeding aggregate through the feed tube to the tamper head, wherein the tamper head may include a plurality of cutting teeth on a lower edge of the tamper head opposite the feed tube and surrounding a perimeter of the tamper head edge. The cutting teeth may cover anywhere from about 20% to about 80% of the cross sectional the cross-sectional area of the tamper head edge. Additionally, the cutting teeth range may range in width from about 0.5 inches (1.2 cm) to about 6 inches and may range in depth from about 0.25 inches (0.6 cm) to about 6 inches (15.2 cm). Further still, the cutting teeth may be spaced apart from each other by a distance equal to about the width of the cutting teeth, or may be spaced apart from each other by a distance greater than or less than the width of the cutting teeth. The cutting teeth may increase driving stresses at the tamper head edge by a factor of about 1.25 to about 5.

In some embodiments, the mandrel may include at least one hydrojet nozzle on the lower edge of the tamper head. The hydrojet nozzle may be installed in at least one of the cutting teeth and may further be installed at an angle ranging from about 10 to about 80 degrees from horizontal. Additionally, the hydrojet nozzle may be fluidly connected to an interior manifold that connects to one or more jet tubes extending internally or externally down the feed tube. In operation, the hydrojet nozzle may generate a stream ranging in diameter from between about 1/1000 of an inch (0.0254 mm) to about 0.25 inches (0.6 cm) and having a pressure ranging from about 10 psi (68.9 kPa) to 4,000 psi (27,579 kPa). In some embodiments, the mandrel also includes one or more diametric restriction elements.

In certain other embodiments, a system for constructing grouted aggregate piers may include a mandrel having an upper feed tube portion, a tamper head, and a passage extending therethrough for feeding aggregate through the feed tube to the tamper head, and a grout injection line extending alongside the feed tube with at least one discharge port into the mandrel. The discharge port may be located, for example, in the feed tube at a location above the tamper head. Certain embodiments may also include a grout inspection line extending alongside the feed tube that includes a grout inspection port located at a distance above the discharge port of the grout injection line. In such embodiments, the grout inspection line includes one of a hardened pipe, a flexible hose, or a combination thereof.

In still other embodiments, the grout injection line may split into two or more grout injection lines at a splitter. These grout injection lines may be integrated into the tamper head and may also wrap around the tamper head until they are opposite each other at a lower edge of the tamper head. In some embodiments, a deflector plate may be disposed below the discharge port of each of the two grout injection lines.

Other embodiments may also include a system wherein the tamper head includes an upper end and a lower end, and further wherein the upper end has a diameter less than the diameter of the lower end. The mandrel may also include one or more diametric restriction elements.

In certain other embodiments, a method of constructing aggregate piers is presented wherein the method includes the steps of (a) providing a mandrel, the mandrel including an upper feed tube portion, a tamper head, and a passage extending therethrough for feeding aggregate through the feed tube to the tamper head, wherein the tamper head comprises a plurality of cutting teeth on a lower edge of the tamper head opposite the feed tube and surrounding a perimeter of the tamper head edge; (b) driving the mandrel into free-field soils to a specified depth; (c) lifting the mandrel a specified distance; and (d) repeating the driving and lifting of the mandrel.

According to yet another aspect of the present disclosure, a method of constructing aggregate piers is presented wherein the method includes the steps of (a) providing a mandrel having an upper feed tube portion, a tamper head, and a passage extending therethrough for feeding aggregate through the feed tube to the tamper head, and one or more grout injection lines extending alongside the feed tube with at least one discharge port into the mandrel; (b) driving the mandrel through free-field soils to a specified depth; (c) lifting the mandrel a specified distance; and (d) repeating the driving and lifting of the mandrel, wherein grout is introduced into the mandrel through the one or more grout lines at pre-determined depths during the repeated driving and lifting process.

BRIEF DESCRIPTION OF THE DRAWINGS

Figure 1A:
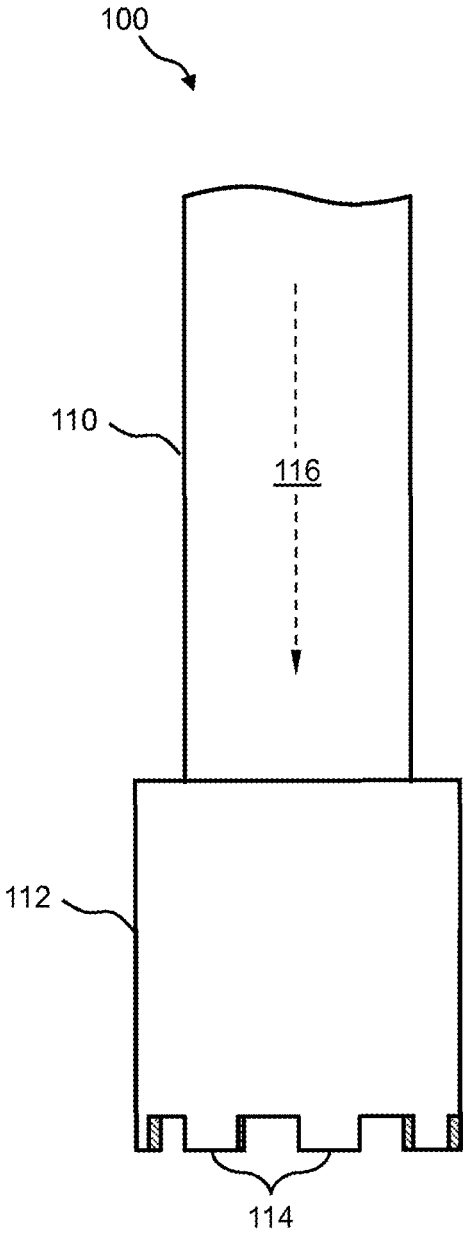
Figure 1B:
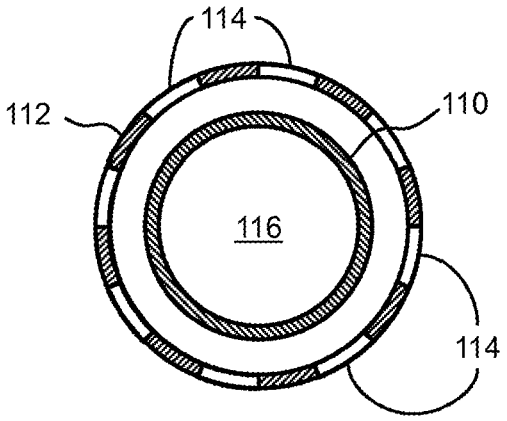
Figure 2:
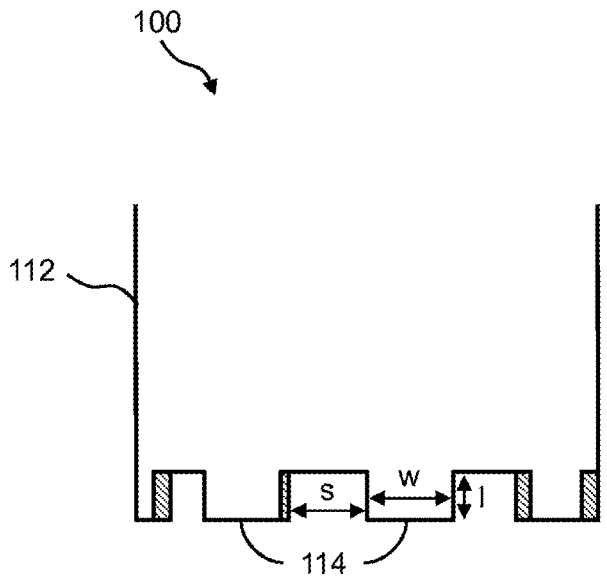
Figure 3A:
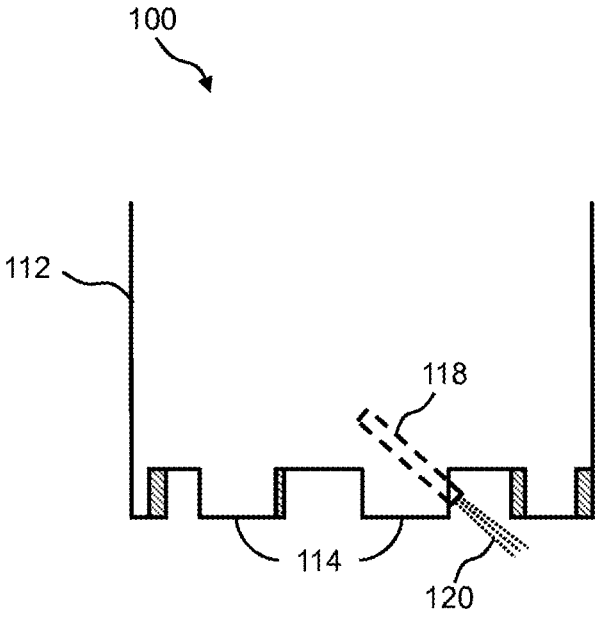
Figure 3B:
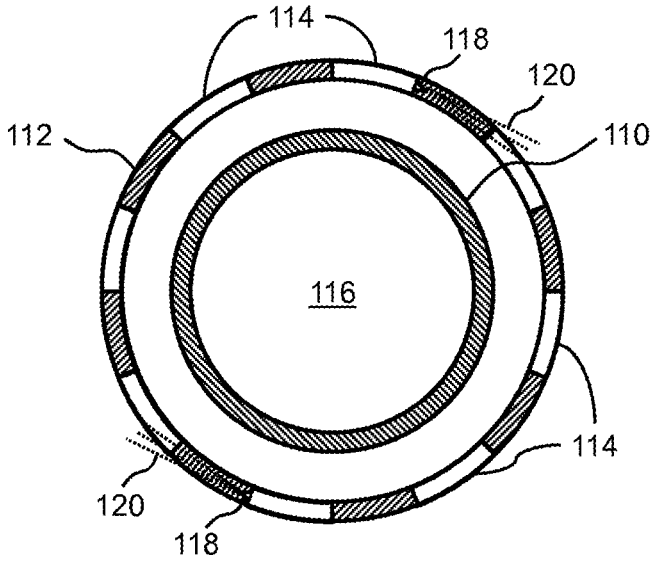
Figure 4A:
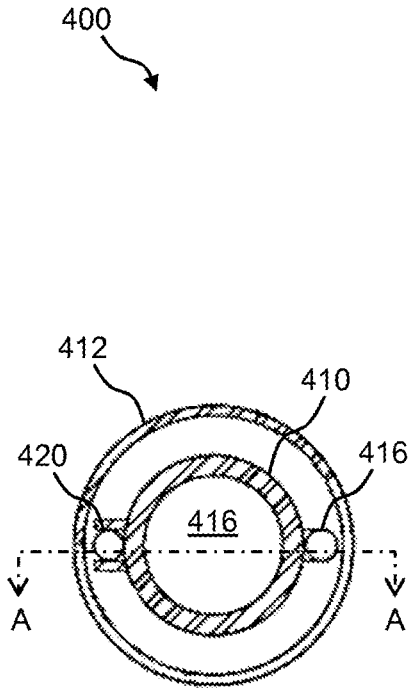
Figure 4B:
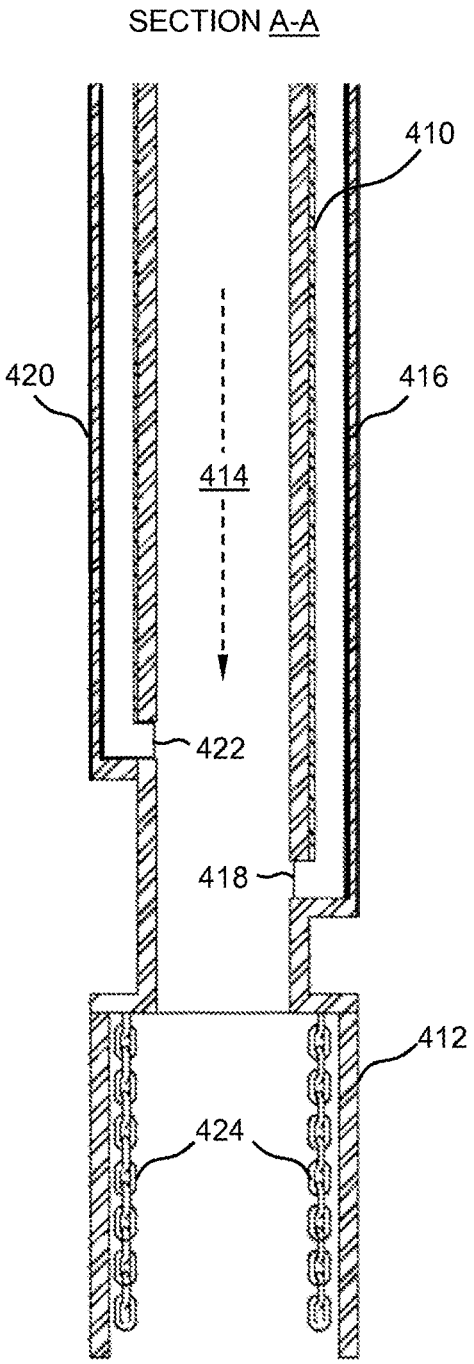
Figure 5A:
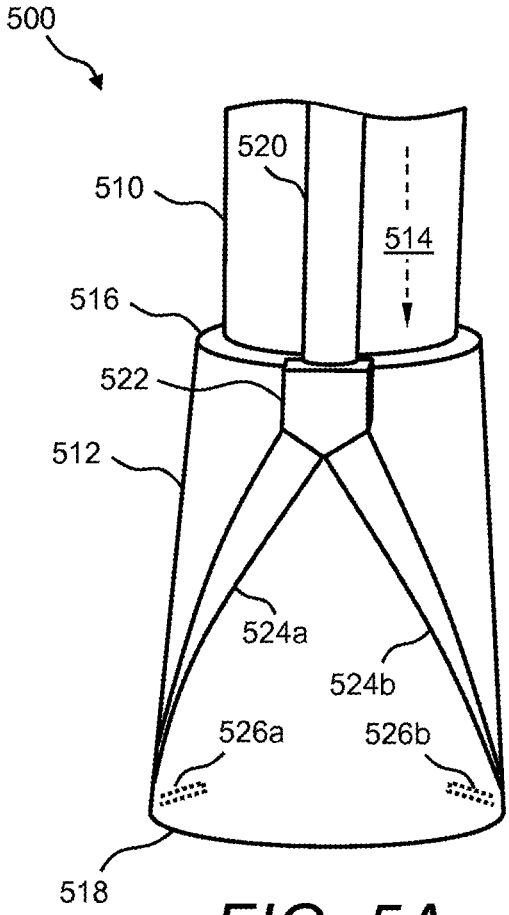
Figure 5B:
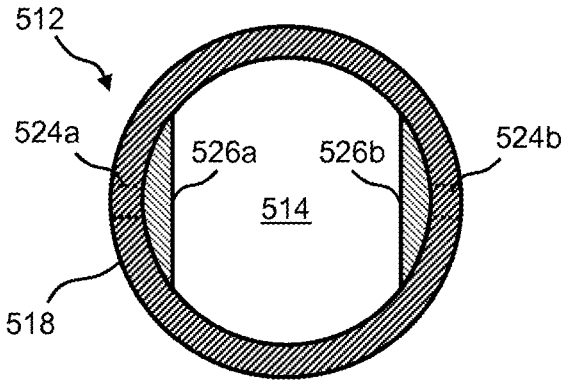
Figure 6A:
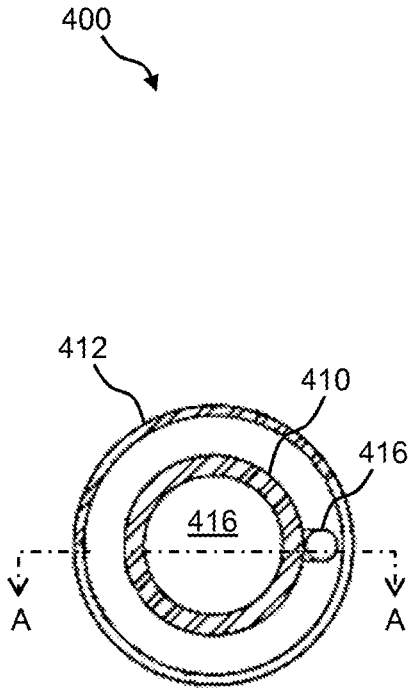
Figure 6B:
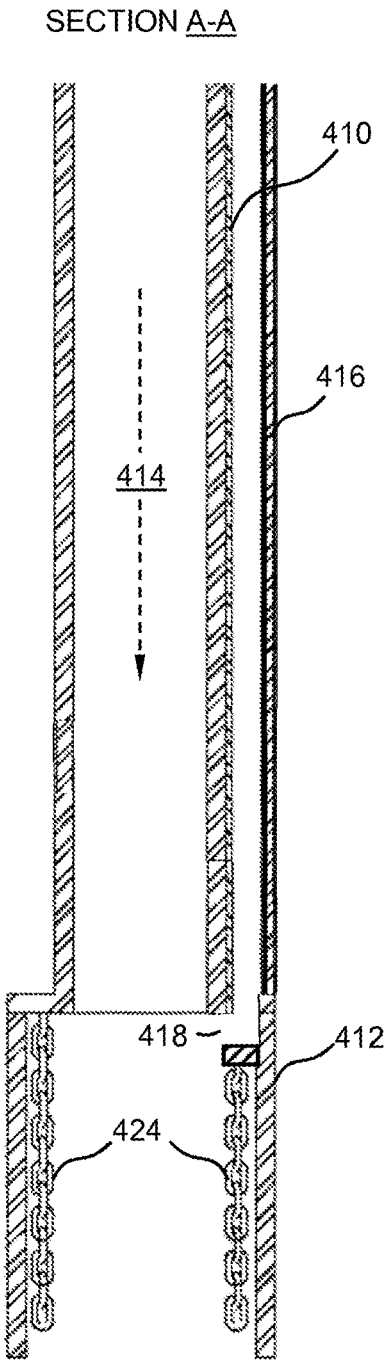
Figure 7:
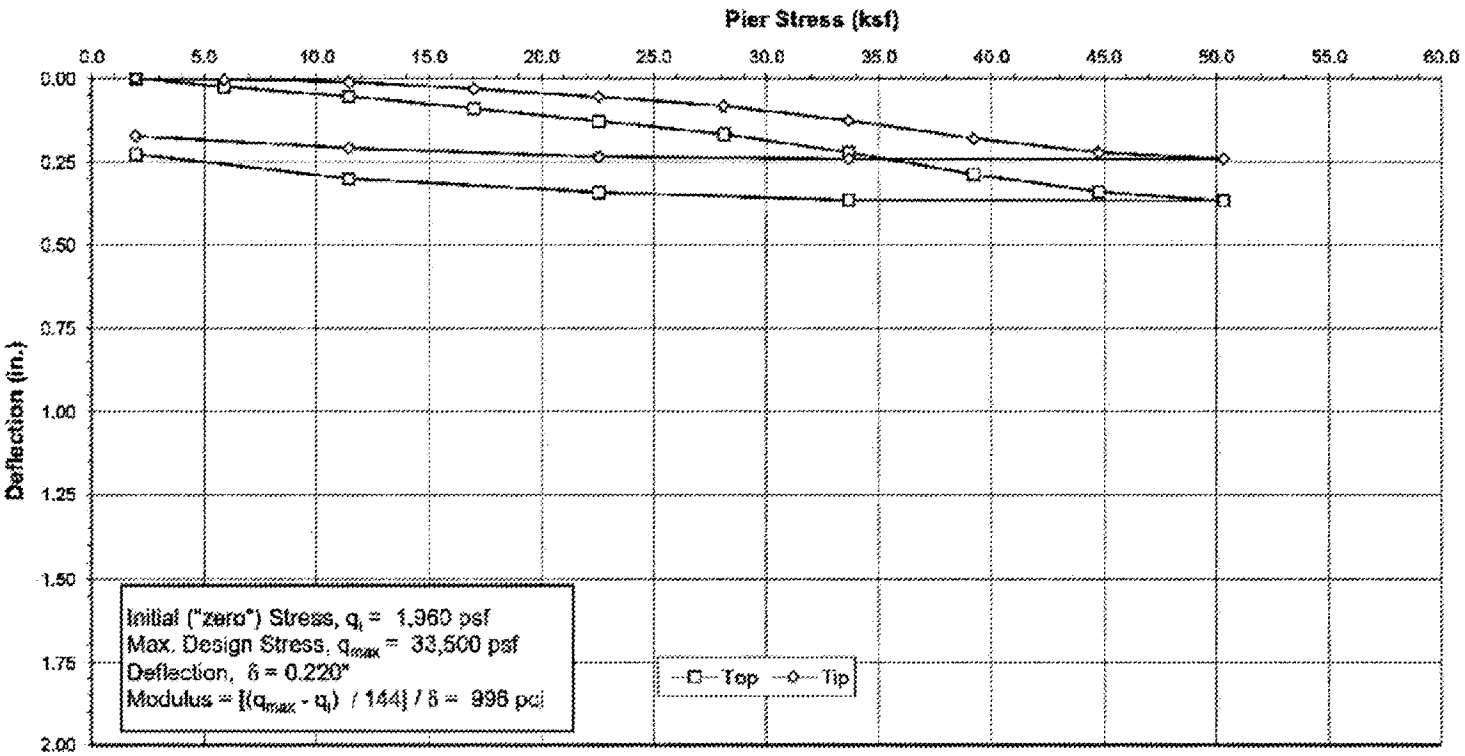

Having thus described the presently disclosed subject matter in general terms, reference will now be made to the accompanying Drawings, which are not necessarily drawn to scale, and wherein:

FIG. 1A and FIG. 1B illustrate a side view and a bottom end view, respectively, of an example of a mandrel that has a tamper head with cutting teeth on the leading edge thereof;

FIG. 2 illustrates a side view showing more details of the cutting teeth of the tamper head shown in FIG. 1A and FIG. 1B;

FIG. 3A and FIG. 3B illustrate a side view and a bottom end view, respectively, showing more details of the tamper head shown in FIG. 1A and FIG. 1B comprising hydrojet nozzles;

FIG. 4A and FIG. 4B illustrate a top view and a cross-sectional view, respectively, of an example of a mandrel that comprises one or more grout tubes for adding grout to aggregate piers;

FIG. 5A and FIG. 5B illustrate a side view and a bottom end view, respectively, of another example of a mandrel that comprises one or more grout tubes for adding grout to aggregate piers;

FIG. 6A and FIG. 6B illustrate a top view and a cross-sectional view, respectively, of an example of a mandrel that comprises one or more grout tubes for adding grout to aggregate piers, according to another embodiment; and FIG. 7 shows a plot of the grouted pier modulus test results for a 24-inch (61-cm) diameter pier formed using, for example, the mandrel shown in FIG. 5A and FIG. 5B.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides apparatuses for efficiently constructing displacement aggregate piers in difficult driving conditions and/or in soils requiring that the pier be grouted to achieve structural support. In one example, the aggregate piers constructed using the presently disclosed apparatuses are used to support structures, such as buildings, foundations, floor slabs, walls, embankments, pavements and other improvements.

An aspect of the presently disclosed apparatuses for efficiently constructing displacement aggregate piers is that they provide improvements to the tamper head driven mandrel method of efficiently constructing displacement aggregate piers.

Another aspect of the present disclosure is that it provides improved apparatuses and methods for constructing grouted aggregate piers.

In some embodiments, a mandrel is provided that has a tamper head with cutting teeth on the leading edge thereof, wherein the cutting teeth provide a more efficient means of penetrating the mandrel into hard or dense materials during driving.

In other embodiments, hydrojet nozzles are provided within one or more of the cutting teeth for delivering liquid under pressure, which can be used for the loosening of dense, stiff, and/or cemented materials that may be encountered during driving.

In yet other embodiments, a mandrel is provided that has grout tubes (or grout injection lines) and/or grout inspection lines, wherein the grout tubes are used to facilitate adding grout more accurately to piers constructed in very soft and weak soil.

In still other embodiments, the presently disclosed mandrel and/or tamper head can comprise cutting teeth, hydrojet nozzles, grout tubes (or grout injection lines), grout inspection lines, and any combinations thereof.

Referring now to FIG. 1A and FIG. 1B, a side view and a bottom end view, respectively, are provided showing an example of a mandrel 100 that has a tamper head with cutting teeth 114 on a leading edge thereof. FIG. 1A and FIG. 1B show an exemplary embodiment of the present embodiment for conditions characterized by difficult tamper head driving. For example, mandrel 100 may comprise a feed tube 110 and a tamper head 112, wherein feed tube 110 has a passage 116 running therethrough for feeding aggregate (not shown) to tamper head 112. Additionally, tamper head 112 may comprise a plurality of cutting teeth 114 on the leading edge thereof; namely, cutting teeth 114 may be on the edge of tamper head 112 opposite feed tube 110. Feed tube 110 and tamper head 112 can be formed of, for example, metallic materials such as steel, cast iron, and/or aluminum.

Cutting teeth 114 are typically installed or machined at the bottom edge or leading edge of tamper head 112. The purpose of cutting teeth 114 is to provide a more efficient means of penetrating mandrel 100 into hard or dense materials during driving. It is well known by those skilled in the art that the penetration of an object into the ground depends on, among other things, the characteristics of the subsurface materials, the presence or lack of ground water, the driving energy applied, and the cross-sectional area of the object being driven into the subsurface materials. The presently disclosed mandrel 100 provides for the installation or machining of driving teeth or cutting teeth that advantageously reduce the cross-sectional area of tamper head 112 at the point of penetration into the ground.

The driving stress that is applied to the leading edge of tamper head 112 may be computed as the ratio of the driving force applied by the driving hammer to the cross-sectional area of the driving surface of tamper head 112. The greater the driving stress, the more rapid the penetration of tamper head 112 into the subsurface materials. In one example, cutting teeth 114 cover from about 20% to about 80% of the cross-sectional area of the cross-sectional driving area of tamper head 112.

Referring now to FIG. 2, a side view of the tamper head 112 shown in FIG. 1A and FIG. 1B is provided showing more details of cutting teeth 114. Cutting teeth 114 have a width w and a length 1. Further, there is a space s between adjacent cutting teeth 114. In one example, the width w of cutting teeth 114 can be from about 0.5 inches (1.3 cm) to about 6 inches (15.2 cm). In one example, the length 1 of cutting teeth 114 can be from about 0.25 inches (0.6 cm) to about 6 inches (15.2 cm). The width w of cutting teeth 114 and space s between cutting teeth 114 can be the same or can be different.

The provision of cutting teeth 114 increases the driving stresses at the leading edge of tamper head 112 by a factor of from about 1.25 to about 5 depending on the configuration and geometry of cutting teeth 114. The magnification of the mandrel-bottom driving stresses allows tamper head 112 to cut into hard-driving materials more rapidly and at reduced wear and tear to the driving hammer as compared with conventional tamper heads. Examples of hard-driving materials include dense or cemented sand, stiff and hard clay, and subsurface obstructions, such as buried concrete pieces and bricks, FIG. 3A and FIG. 3B show another embodiment of mandrel 100 for difficult driving conditions. FIG. 3A and FIG. 3B illustrate a side view and a bottom end view, respectively, showing tamper head 112 equipped with both cutting teeth 114 and one or more hydrojet nozzles 118 that may be installed or machined near the bottom of tamper head 112. The purpose and configuration of cutting teeth 114 is as described above with reference to FIG. 1A, FIG. 1B, and FIG. 2. Hydrojet nozzles 118 may be installed within cutting teeth 114 and inclined at angles ranging from about 10 degrees to about 80 degrees from horizontal. Hydrojet nozzles 118 may be installed in one cutting tooth 114, in two cutting teeth 114, or in many cutting teeth 114 depending on the required effectiveness of the jetting operations. Hydrojet nozzles 118 may generate streams of pressurized water or other liquids (e.g., liquid 120) having a diameter ranging from about 1/1000 of an inch (0.0254 mm) to about 0.25 inches (0.6 cm) depending on the mandrel design and driving requirements. Hydrojet nozzles 118 may be hydraulically connected to an interior manifold (not shown) that may be in turn connected to one or more supply lines (not shown) that extend down along mandrel 100 (or within mandrel 100) from the top of mandrel 100. The purpose of hydrojet nozzles 118 and the interior manifold is to distribute pressurized water or other liquids (e.g., liquid 120) from working grades downward through mandrel 100 and out of hydrojet nozzles 118.

Water jet pressures that can range from about 10 psi (68.9 kPa) to about 4000 psi (27,579 kPa) may be applied through hydrojet nozzles 118 during downward driving. The provision of hydrojet nozzles 118 allows for the loosening of dense, stiff, and/or cemented materials that may be encountered during driving. The application of the high pressure water loosens these materials and allows for more effective driving. Hydrojet nozzles 118 are typically installed at angles that are inclined from vertical so as to prevent clogging the nozzles during mandrel driving and extraction. Hydrojet nozzles 118 that are installed at steep angles provide for easiest driving but are also more easily clogged during mandrel penetration into soil materials. By inclining hydrojet nozzles 118 from vertical, hydrojet nozzles 118 have the advantage that they still angle downwards to loosen the subsurface materials yet are not as easily clogged by soil particles. The provision of cutting teeth 114 allows hydrojet nozzles 118 to be inclined at angles greater than zero degrees from vertical thus allowing for the inclined configuration of hydrojet nozzles 118.

In yet another embodiment of the present invention, grout tubes (or grout injection lines) may be used to facilitate more accurately adding grout to piers constructed in very soft and weak soil. For example, FIG. 4A and FIG. 4B show a top view and a cross-sectional view, respectively, of an example of a mandrel 400 that comprises grout tubes for adding grout to aggregate piers. Mandrel 400 may include a feed tube 410 and a tamper head 412, wherein feed tube 410 has a passage 414 therethrough for feeding aggregate (not shown) to tamper head 412. Feed tube 410 and tamper head 412 can be formed of metallic materials, such as steel, cast iron, and aluminum. In one example, the length or height of tamper head 412 can be from about 6 inches (15.2 cm) to about 12 inches (30.5 cm).

In some embodiments, a grout injection line 416 extends downward alongside feed tube 410 to discharge at a location above tamper head 412. In one example, grout injection line 416 has an inside diameter (ID) of about 2 inches (5 cm). The grout is injected near the bottom of mandrel 400 to provide greater confidence and accuracy in the provision of grout within the aggregate. Namely, in this embodiment, an injection port 418 is located above tamper head 412 to reduce the likelihood of grout injection line 416 clogging during compaction facilitated by tamper head 412. In one example, injection port 418 is located at least about 6 inches (15.2 cm) above the top edge of tamper head 412. Grout injection line 416 may be used to accurately inject known volumes of grout at known elevations of tamper head 412. This allows for greater confidence in the location and presence of the added grout within the aggregate pier. Because of this greater confidence, the total volume of grout added to the pier may be reduced, thereby providing cost efficiencies. Further, because grout injection line 416 allows for more accuracy, the pier may be constructed with grout extending to a lower top of grout elevation, thus reducing the potential for post-pier-construction grout chipping activities for piers that are constructed with grout above design elevations.

Optionally, as shown in FIG. 4A and FIG. 4B, a grout inspection line 420 may be provided that also extends downward alongside feed tube 410. In one example, grout inspection line 420 has an ID of about 2 inches (5 cm). Grout inspection line 420 may be used for providing an independent verification of grout quantities. Grout inspection line 420 is optimally located above the discharge point (i.e., injection port 418) of grout injection line 416. Namely, grout inspection line 420 has an inspection port 422 that is typically located some distance above injection port 418 of grout injection line 416. Grout inspection line 420 may consist of a hardened pipe that is affixed or attached to the side of mandrel 400, or it may consist of a flexible hose, or a combination of the two. The purpose of grout inspection line 420 is to verify the elevation of the head of grout within mandrel 400. If grout is observed to emerge from grout inspection line 420 then the pressure head of grout at the elevation of inspection port 422 is known to be equal to or to exceed the elevation of injection port 418 of grout injection line 416.

Further, optionally a set of diametric restriction elements 424 may be installed in tamper head 412 of mandrel 400. Diametric restriction elements 424 can be fabricated from individual chains, cables, or wire rope, or a lattice of vertically and horizontally connected chains, cables, or wire rope. In a specific example, the diametric restriction elements 424 are half-inch (1.3-cm), grade 100 alloy chains. In one example, after initial driving, mandrel 400 is raised and the diametric restriction elements 424 hang freely by gravity from the bottom of tamper head 412. As tamper head 412 is raised the aggregate/grout flows into the cavity left by tamper head 412. After raising tamper head 412 the prescribed distance, tamper head 412 is then re-driven downwardly to a depth preferably less than the initial driving depth into the underlying materials. This allows the diametric restriction elements 424 the opportunity to expand radially and "bunch up" forming a compaction surface within the tamper head 412 that substantially reduces or prevents aggregate from moving upward relative to the tamper head 412. It is further understood that the tamper head with teeth of FIG. 1A, 1B, 2, or 3A and 3B may also further comprise diametric restriction elements installed therein.

Referring now to FIG. 5A and FIG. 5B, a side view and a bottom end view, respectively, of another example of a mandrel 500 are provided. In this example, the mandrel 500 includes grout tubes (or grout injection lines) for adding grout to aggregate piers, wherein the grout tubes are used to facilitate more accurately adding grout to piers constructed in very soft and weak soil. For example, mandrel 500 includes a feed tube 510 and a tamper head 512, wherein feed tube 510 has a passage 514 running therethrough for feeding aggregate (not shown) to tamper head 512. Feed tube 510 and tamper head 512 can be formed of, for example, metallic materials such as steel, cast iron, and aluminum. Tamper head 512 has an upper end 516 and a lower end 518. In one example, feed tube 510 has an outside diameter (OD) of about 11 inches (27.9 cm) and an ID of about 9 inches (22.9 cm). In this example, the OD and ID of upper end 516 of tamper head 512 is smaller than the OD and ID of lower end 518 of tamper head 512. For example, upper end 516 of tamper head 512 has an OD of about 16 inches (40.6 cm) and an ID of about 14 inches (35.6 cm), while lower end 518 of tamper head 512 has an OD of about 18 inches (45.7 cm) and an ID of about 16 inches (40.6 cm).

In some embodiments, a grout injection line 520 may extend downward alongside feed tube 510. In one example, grout injection line 520 is a 2-inch (5-cm) ID black pipe. A grout hose (not shown) may attach to the top of grout injection line 520. The bottom end of grout injection line 520 may be fluidly coupled to a splitter 522 that supplies two or more grout lines 524 (e.g., grout lines 524*a*, 524*b*). In one example, two grout lines 524 are integrated into the walls of tamper head 512 and wrap around the sides of tamper head 512 until they are opposite of each other. The two or more grout lines 524 can be, for example, hardened pipe, flexible hose, or a combination thereof. In certain other embodiments, the two or more grout lines 524 can be made of the same material as tamper head 512. It is understood that more than two grout lines may be provided (with resulting multiple splitting).

Each of the two grout lines 524 may include a deflector plate 526. For example, a deflector plate 526*a* may be located below the end of grout line 524*a* and a deflector plate 526*b* may be located below the end of grout lines 524*b*. Deflector plates 526*a*, 526*b* help to direct the grout to the center of tamper head 512 as it is pumped and to keep soil/aggregate from plugging grout lines 524*a*, 524*b* during driving. In this embodiment, the grout is injected near the bottom of mandrel 500 to provide greater confidence and accuracy in the provision of grout within the aggregate.

In other embodiments, the presently disclosed mandrel 500 and/or tamper head 512 may further include cutting teeth 114, hydrojet nozzles 118, grout tubes (or grout injection lines) (e.g., 416, 520), grout inspection lines (e.g., 420), and any combinations thereof.

Referring now to FIG. 6A and FIG. 6B, a top view and a cross-sectional view, respectively, are shown of another example of a mandrel 400 that comprises one or more grout tubes for adding grout to aggregate piers. Unlike the embodiment shown in FIG. 4A and FIG. 4B, here the one or more grout lines 416 discharge directly into the tamper head 412 rather than discharging into the feed tube 410 above tamper head 412. Additionally, FIG. 6A and FIG. 6B show an embodiment of the mandrel 400 that optionally does not include one or more grout inspection lines, like grout inspection line 420 shown in FIG. 4A and FIG. 4B.

Having generally described the presently disclosed apparatuses for constructing displacement aggregate piers, it is more specifically described by illustration in the following specific EXAMPLE.

Example

In one example of the present subject matter, a method of injecting grout into an aggregate pier within a targeted zone of very soft and weak soils using the grout injection tubes was demonstrated in full-scale field tests.

The piers were installed with a Liebherr 125 base machine equipped with a grout pump and hopper. A pump hose ran from the pump to the top of the mandrel. The mandrel was equipped with a 2 inch ID grout pipe 520 similar to that shown in FIG. 5A and FIG. 5B that ran along the full length of the mandrel pipe 510. At the bottom of the mandrel, the pipe split into two pipes wrapped around the sides of the head until the discharge locations were opposite to each other. A deflector plate was located below the end of the grout discharge locations to help the grout move to the center during pumping.

Several grout mixes were evaluated during the testing program resulting in a finalized grout mix that had the proper viscosity to allow for pumping but to not freely permeate through the voids within the aggregate pier. The final grout mix consisted of 242 lbs (110 kg) of water, 660 lbs (299 kg) of cement, 990 lbs (449 kg) of sand (playground), 500 mL of retarder (i.e., EUCON W.O.), and 1,650 mL of superplasticizer (i.e., EUCON 37 superplasticizer). The grout was mixed with a paddle mixer and tested with flow cone test per ASTM C939 to achieve a flow that ranged from 40 to 60 seconds.

The piers were constructed by driving the mandrel through the fill, peat, and clean sand to a depth of about 30 feet (9.1 m). Stone was wetted and added to the mandrel hopper. An ungrouted pier was constructed using a 5 ft/4 ft (1.5 m/1.2 m) stroke pattern over the lower 17 feet (5.2 m) in the clean sand. At a depth of 1 foot (0.3 m) below the peat layer, the mandrel was held stationary and grout was introduced into the mandrel through the grout pipes. After a specific volume of grout was introduced, a single lift was constructed with a 3 ft/3 ft (0.9 m/0.9 m) stroke pattern at a depth of 13 feet (4.0 m), and then the upper portion of the pier through the peat and fill from a depth of 13 feet (4.0 m) to 4 feet (1.2 m) was constructed with grouted stone using a 3 ft/2 ft (0.9 m/0.6 m) stroke pattern. At a depth of 4 feet (1.2 m) grouting was stopped and the upper 4 feet (1.2 m) of the pier was constructed with ungrouted stone using a 3 ft/2 ft (0.9 m/0.6 m) stroke pattern.

A modulus test was performed on a constructed pier. The results shown in plot 700 of FIG. 7 indicate that the constructed piers confirmed the design and were sufficient to support the structure.

Several hundred piers were installed at this site with the technique described above. Traditional aggregate pier grouting methods with low viscosity grout were not feasible at this site because the grout would permeate through the pier and into the clean sand matrix soil along the lower 17 feet (5.2 m) of the pier. Additionally, traditional grouting methods do not allow for accurately starting and stopping the grouting process at the targeted depth of the peat soils. The advantage of introducing grout within a targeted zone rather than grouting the entire pier length as with traditional aggregate pier grouting methods resulted in a significant reduction in the volume of grout required for each pier and in the overall cost of the project.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A system for constructing grouted aggregate piers, comprising:

a) a mandrel having an upper feed tube portion, a tamper head, and a passage extending therethrough for feeding aggregate through the feed tube to the tamper head; and b) a grout injection line extending alongside the feed tube with at least one discharge port into the mandrel, wherein the grout injection line splits into two or more grout injection lines at a splitter, and further wherein the grout injection lines wrap around the tamper head until they are opposite each other at a lower edge of the tamper head.

2. The system of claim 1 further comprising at least one hydrojet nozzle on the lower edge of the tamper head.

3. The system of claim 2 wherein the hydrojet nozzle is installed at an angle ranging between 10 and 80 degrees from horizontal.

4. The system of claim 2 wherein a stream generated by the hydrojet nozzle ranges in diameter from between 1/1000 of an inch (0.0254 mm) to 0.25 inches (0.6 cm).

5. The system of claim 2 wherein the hydrojet nozzle is fluidly connected to an interior manifold that connects to one or more jet tubes extending internally or externally down the feed tube.

6. The system of claim 2 wherein the stream from the hydrojet nozzle ranges in pressure from 10 psi (68.9 kPa) to 4,000 psi (27,579 kPa).

7. The system of claim 1 wherein the discharge port is located in the tamper head.

8. The system of claim 7 further comprising a grout inspection line extending alongside the feed tube and comprising a grout inspection port located at a distance above the discharge port of the grout injection line.

9. The system of claim 8 wherein the grout inspection line comprises one of a pipe, a flexible hose, or a combination thereof.

10. The system of claim 1 wherein the discharge port is located in the feed tube at a location above the tamper head.

11. The system of claim 1 wherein the two grout injection lines are integrated into the tamper head.

12. The system of claim 1 further comprising a deflector plate disposed below the discharge port of each of the two grout injection lines.

13. The system of claim 1 wherein the tamper head comprises an upper end and a lower end, and further wherein the upper end has a diameter less than the diameter of the lower end.

14. The system of claim 1 wherein the mandrel further comprises one or more diametric restriction elements.

15. A method of constructing aggregate piers, the method comprising the steps of:

a) providing a mandrel having an upper feed tube portion, a tamper head, and a passage extending therethrough for feeding aggregate through the feed tube to the tamper head, and one or more grout injection lines extending alongside the feed tube with at least one discharge port into the mandrel, wherein the grout injection line splits into two or more grout injection lines at a splitter, and further wherein the grout injection lines wrap around the tamper head until they are opposite each other at a lower edge of the tamper head;

b) driving the mandrel through free-field soils to a specified depth;

c) lifting the mandrel a specified distance; and d) repeating the driving and lifting of the mandrel;

wherein grout is introduced into the mandrel through the one or more grout lines at pre-determined depths during the repeated driving and lifting process.

16. The system of claim 1, further comprising cutting teeth on the tamper head.

* * * * *